US005337812A

United States Patent [19]

Schmitt

[11] Patent Number: 5,337,812

[45] Date of Patent: Aug. 16, 1994

[54] BLADE HEAD FOR CUTTING BLADES

[75] Inventor: Gerhard Schmitt, Grossrinderfeld, Fed. Rep. of Germany

[73] Assignee: Michael Weinig Aktiengesellschaft, Tauberbischofscheim, Fed. Rep. of Germany

[21] Appl. No.: 65,347

[22] Filed: May 19, 1993

[51] Int. Cl.[5] ..... B26D 1/12; B27G 13/04

[52] U.S. Cl. ..... 144/230; 144/117 R; 144/218; 407/49; 407/120

[58] Field of Search ..... 144/114 R, 117 R, 218, 144/230; 51/108 R; 409/234, 241; 407/49, 120

[56] References Cited

U.S. PATENT DOCUMENTS

| | | | |
|---|---|---|---|
| 2,652,749 | 9/1953 | Hagmeister . | |
| 2,842,233 | 7/1958 | Greenleaf | 407/49 |
| 2,862,286 | 12/1958 | Williams | 407/49 |
| 2,920,896 | 1/1960 | Buck . | |
| 3,987,525 | 10/1976 | Hasfjord | 407/49 |
| 4,475,425 | 10/1984 | Punater et al. | 407/49 |
| 4,594,928 | 6/1986 | Thomas et al. | 144/230 |
| 4,922,977 | 5/1990 | Colton et al. | 144/230 |

FOREIGN PATENT DOCUMENTS

| | | |
|---|---|---|
| 0182037 | 5/1986 | European Pat. Off. . |
| 492564 | 2/1930 | Fed. Rep. of Germany . |
| 839556 | 5/1952 | Fed. Rep. of Germany . |
| 1195934 | 7/1965 | Fed. Rep. of Germany . |
| 25880 | 1/1932 | Netherlands . |

*Primary Examiner*—W. Donald Bray
*Attorney, Agent, or Firm*—Robert W. Becker & Associates

[57] ABSTRACT

A blade head for cutting and planing blades has a blade holder having a plurality of receiving grooves for receiving a cutting and planing blade. The receiving grooves are distributed over the circumference of the blade holder. A plurality of pressurizing elements is positioned in each of the receiving grooves for securing the cutting and planing blade in the receiving groove. At least one adjusting member is positioned in each of the receiving grooves for forcing the pressurizing elements against one another such that the pressurizing elements exert a clamping pressure on the cutting and planing blade. The pressurizing elements have a substantially cylindrical shape with wedge-shaped end faces and a circumferential surface having at least one planar clamping surface. Adjacent ones of the pressurizing elements abut one another with their end faces. The blade holder has clamping counter surfaces cooperating with the planar clamping surfaces of the pressurizing elements.

11 Claims, 5 Drawing Sheets

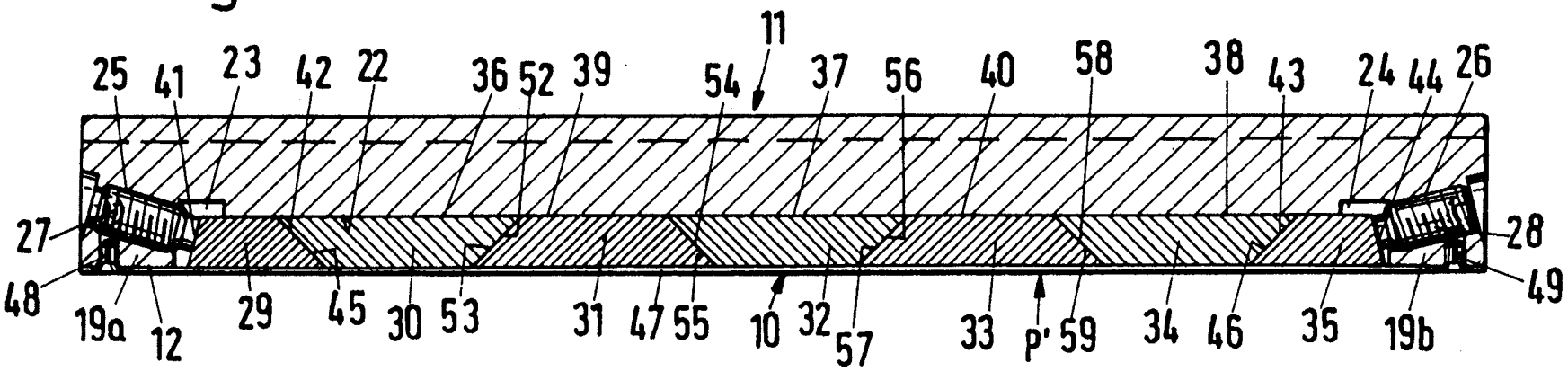
Fig.2
Fig.3
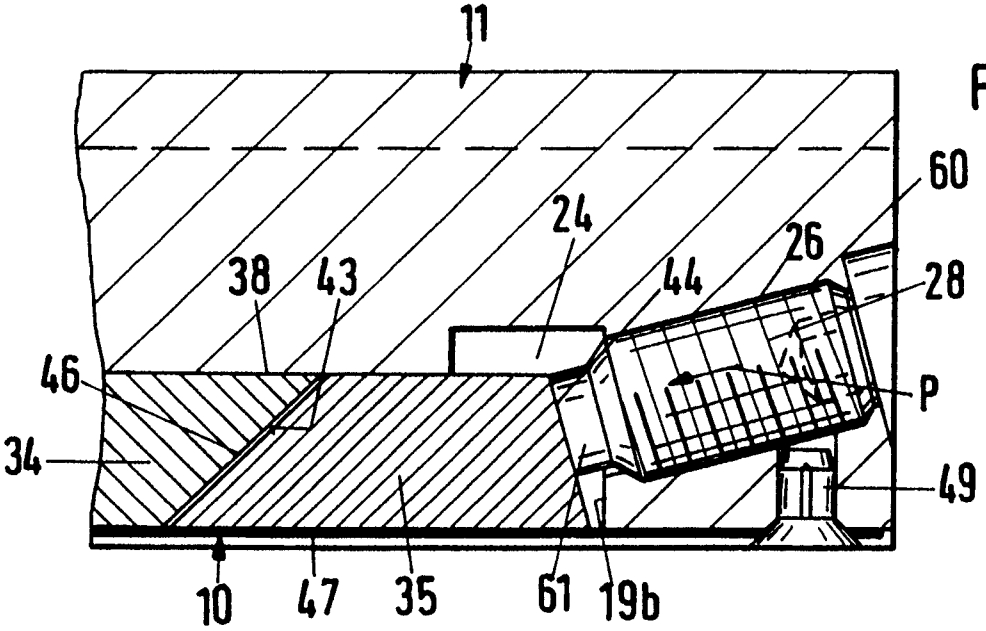

BLADE HEAD FOR CUTTING BLADES

BACKGROUND OF THE INVENTION

The present invention relates to a blade head especially for cutting and planing blades for wood or plastic machining devices. The blade head has a blade holder with a plurality of receiving grooves for receiving a cutting and planing blade, the receiving grooves distributed over the circumference of the blade holder; a plurality of pressurizing elements positioned in each of the receiving grooves for holding the cutting and planing blade within the receiving groove; and an adjusting member positioned in each of the receiving grooves for forcing the pressurizing elements against one another such that the pressurizing elements exert a clamping pressure on the cutting and planing blade.

For clamping blades within a known blade heads, commonly a hydroclamping sleeve is used with which via pistons the pressure medium is applied. The pressurizing elements for clamping the blades are outwardly forced whereby the blade is thus secured within the receiving grooves. A disadvantage of these known blade heads is that the clamping pistons within the blade holder are radially positioned between the receiving grooves and an opening for the spindle of the blade head. This arrangement results in a weakened structure of the blade holder within the radial area. Furthermore, the blades can become loose when the hydroclamping sleeve or one of the clamping pistons has a leak.

From European publication 0 182 037 a blade head is known in which the blades are clamped by steel balls resting at one another within the receiving groove. They are forced against one another by an adjusting element in the form of a set screw whereby they are alternately forced radially outwardly and radially inwardly and rest under prestress at the bottom of the receiving groove as well as at the abutment surfaces of the blades. With the steel balls only a point contact at the corresponding counter clamping surfaces is achieved so that these counter clamping surfaces as well as the steel balls are subject to a considerably high load and therefore also to great wear.

It is therefore an object of the present invention to provide a blade head of the aforementioned kind with which the blades can be clamped in a simple and reliable manner without substantially weakening the blade holder whereby a high load on the parts partaking in the clamping process should be prevented.

BRIEF DESCRIPTION OF THE DRAWINGS

This object, and other objects and advantages of the present invention, will appear more clearly from the following specification in conjunction with the accompanying drawings, in which:

FIG. 2 shows an axial section of a clamping unit within the receiving groove of the blade head for clamping a blade arranged in the receiving groove;

FIG. 3 shows a detail of the clamping unit of FIG. 2;

SUMMARY OF THE INVENTION

Figure 1:
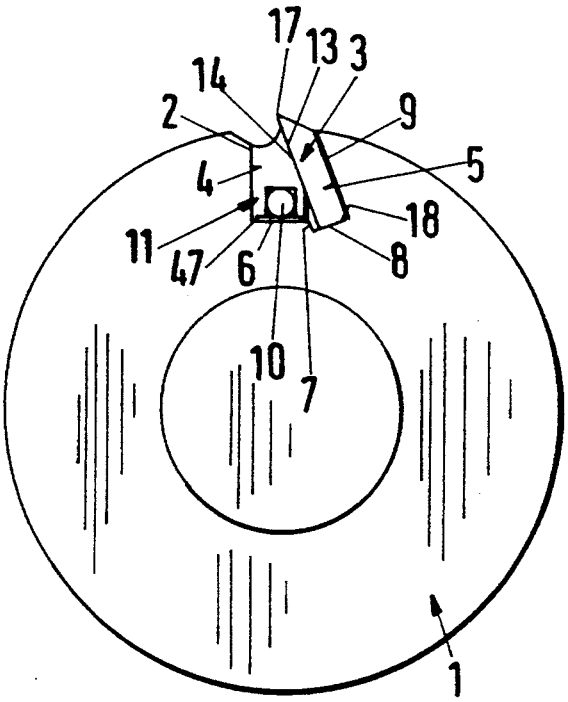
FIG. 1 shows the inventive blade head in a simplified representation in an end view.

The blade head for cutting and planing blades according to present invention is primarily characterized by:

A blade holder having a plurality of receiving means for receiving a cutting and planing blade, the receiving means distributed over a circumference of the blade holder;

A plurality of pressurizing elements positioned in each of the receiving means for holding the cutting and planing blade in the receiving means;

At least one adjusting member positioned in each of the receiving means for forcing the pressurizing elements against one another such that the pressurizing elements exert a clamping pressure on the cutting and planing blade;

The pressurizing elements have a substantially cylindrical shape with wedge-shaped end faces, and with a circumferential surface having at least one planar clamping surface, with adjacent ones of the pressurizing elements abutting one another with the end faces; and The blade holder having clamping counter surfaces cooperating with the planar clamping surface of the pressurizing elements.

With the inventive blade head the pressurizing elements with their wedge-shaped end faces rest at one another so that an areal force transmission can be achieved. Due to the wedge-shaped end faces the abutting pressurizing elements are alternately moved inwardly and outwardly until they rest with their planar clamping surfaces at the counter clamping surfaces provided at the blade head. Accordingly, with these clamping surfaces an areal force transmission takes place so that a high load of the components participating in the clamping process of the inventive blade head is prevented. Furthermore, via the areal support of the pressurizing elements at one another and at the counter clamping surfaces an optimal force transmission is ensured so that the blades are securely clamped within the blade head. During insertion of the blade head into a machine a loosening of the blades thus cannot occur. The planar clamping surfaces of the pressurizing elements furthermore provide a rotational securing means for preventing a rotation of the pressurizing elements about their axis. During the clamping process the pressurizing elements are aligned relative to one another via their wedge-shaped end faces. Via the planar clamping surfaces an alignment relative to the counter clamping surfaces takes place so that the areal abutment of the planar clamping surfaces at the counter clamping surfaces needed for an optimal force transmission is ensured in a simple manner.

According to a preferred embodiment of the present invention, the planar clamping surfaces are positioned at an acute angle to the wedge-shaped end faces. Furthermore, each pressurizing element has two of the planar clamping surfaces that are parallel to one another. Preferably, a first one of the planar clamping surfaces in the axial direction of the pressurizing element is shorter than a second one of the planar clamping surfaces.

Advantageously, the receiving means comprises a longitudinal slot into which longitudinal slot the pressurizing elements are placed. Preferably, the blade head further comprises a clamping member positioned in each one of the receiving means, the clamping member being provided with the aforementioned longitudinal slot and resting at the cutting and planing blade.

Advantageously, the longitudinal slot has a bottom, longitudinal side walls, and an opening opposite the bottom, the opening being narrower than the bottom. Preferably, each side wall at the opening has a longitudinal projection extending toward one another. Expediently, the distance between the projections is greater than a distance between the two planar clamping surfaces, and a diameter of the cylindrical shape of the pressurizing elements is greater than the distance between the projections. In an alternative embodiment of the present invention, the longitudinal slot is provided within the blade holder.

DESCRIPTION OF PREFERRED EMBODIMENTS

The blade heads according to FIGS. 1 to 10 are primarily used in wood and plastic machining devices for planing, profiling etc. When in use, they are positioned on a spindle, not represented in the drawings, and are rotationally fixedly connected to the spindle. For high feeding speeds and high finished surface qualities the blade heads are preferably hydraulically clamped at the spindle.

The blade head according to FIGS. 1 to 3 is provided with a cylindrical blade holder 1 which about its circumference is provided with receiving means, i.e., receiving grooves 2, spaced at a distance from one another for receiving the blades 3. For simplifying the drawings only one of the receiving grooves is represented. The grooves 2 have an end view according to the representation of FIG. 1 of an approximate trapezoid shape and have outwardly converging sidewalls 4 and 5. The bottom which connects the side walls has three bottom sections 6, 7, 8. The bottom sections 6 and 8 are directly connected perpendicularly to the sidewalls 4 and 5 and are connected to one another by a bottom section 7 that extends approximately perpendicularly to the section 8. Thus, a step is created by the bottom section 7 between bottom sections 6 and 8. The bottom section 8 is radially inwardly positioned relative to the bottom section 6. The blade 3 rests at the longer side wall 5 with its back portion 9 that preferably has a non-represented toothing extending approximately parallel to the axis.

Figure 11:
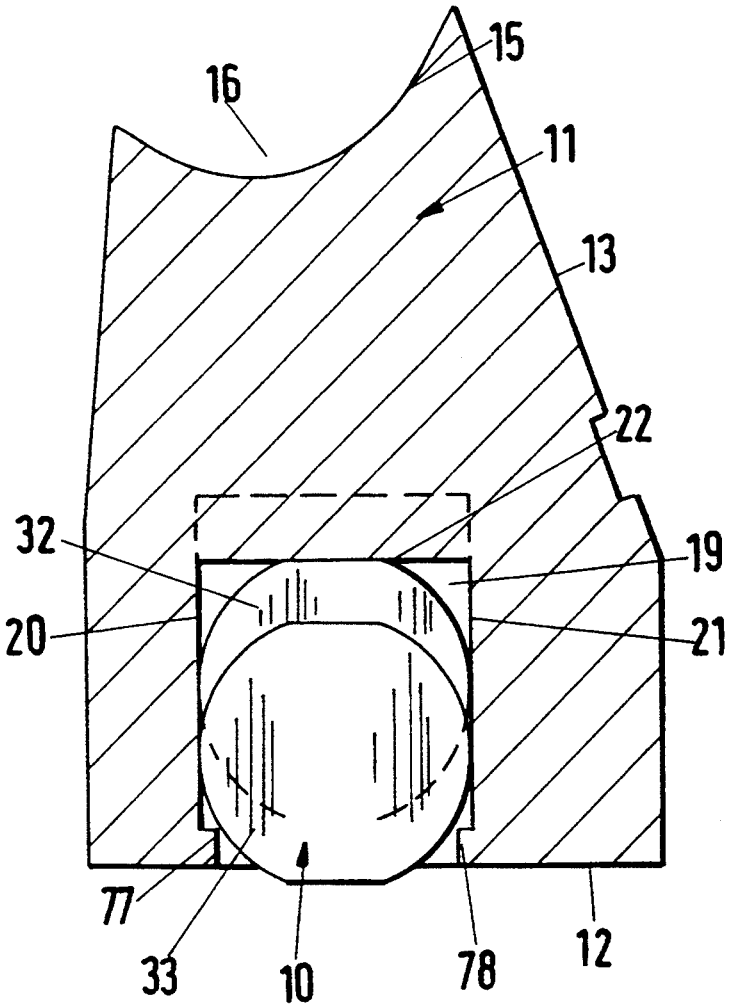
FIG. 11 is an enlarged sectional representation of a clamping element within a groove of the clamping member.

The blade 3 is secured in the receiving groove 2 by a clamping unit. The clamping unit is comprised of a pressurizing member 10 and a clamping member 11 having an approximately rectangular cross-section. The wider lateral side of the clamping member 11 is slanted for receiving the blade 3 and with the planar slanted surface 13 rests at the breast surface 14 of the blade The slanted surface 13 extends parallel to the side wall 5 of the receiving groove 2. The radially outwardly arranged narrow side 15 of the clamping member 11 is provided with a clamping groove 16 (FIG. 11). The blade 3 rests with its narrow side 18, that is opposite to the blade edge 17, on the bottom section 8, however, it is also possible to provide a space between the narrow side 18 and the bottom section 8. With the pressurizing member 10 the clamping member 11 is actuated so that the blade 3 is clamped within the receiving groove 2. The clamping member 11 extends preferably substantially over the entire axial length of the blade holder 1 and the blade 3 while the pressurizing member 10 may be shorter than the clamping member 11 (FIG. 2).

The pressurizing member 10 is arranged within a U-shaped longitudinal slot 19 (FIG. 11) provided at the radially inwardly positioned bottom side 12 of the clamping member 11 that is open to the radially inwardly positioned and planar narrow side 12 of the clamping member 11 and delimited by sidewalls 20, 21 and the bottom 22 extending in the longitudinal direction of the clamping member 11 (FIG. 11). The longitudinal slot 19 is provided with radially enlarged portions 23 and 24 at its ends (FIGS. 2, 3) in which area the longitudinal slot 19 has a greater depth than in the remaining area. The longitudinal slot 19 is delimited on either end by sidewalls **19*a* and 19*b* of the clamping member 11 (FIG. 2). The sidewalls are penetrated by bores 25 and 26 for an abutment 27 and an adjusting member 28. The bores 25, 26 extend from the end face 60 of the clamping member 11 at a slant in the direction toward the bottom section 6**.

The pressurizing member 10 is comprised of a plurality of pressurizing elements 29 to 35, in the shown embodiment seven pressurizing elements are provided, which have the same cross-section and the same trapezoidal longitudinal section (FIG. 2). The pressurizing elements 29 to 35 are arranged to form a pressurizing rod and abut one another, as shown in FIG. 2. The centrally arranged pressurizing elements 30 to 34 are identically embodied. Every other pressurizing element or pressurizing wedge 30, 32, 34 is arranged in the same manner with their greater base surface 36 to 38 resting at the bottom 22 of the slot 19. The interposed pressurizing wedges 31, 33, when not being clamped, rest with their smaller base surface 39 and 40 at the bottom 22. The pressurizing wedges 29 and 35 at the end of the pressurizing rod, in contrast to the other pressurizing wedges 30 to 34, have asymmetrical long end faces 41 to 44. The outwardly arranged lateral surfaces 41 and 44 are shorter than the other end faces 42 and 43 which are identically embodied to the end faces 45 and 46 of the neighboring pressurizing wedges 30 and 34 where they abut.

The pressurizing member 10 rests with one pressurizing wedge 29 at the abutment 27, which in the shown embodiment is a screw. This screw is threaded into the threaded bore 25. At the end face 44 of the other pressurizing wedge 35 arranged at the other end, an adjusting member 28 is provided which is also in the form of a screw.

For securing the position of the pressurizing members 10, respectively, of its pressurizing elements or wedges 29 to 35 within the slot 19 of the clamping member 11, a support 47 is provided that is connected to the clamping member 11 and is advantageously a holding sheet (FIGS. 1 to 3). It is relatively thin and connected with screws 48 and 49 to the clamping member, see FIG. 2.

The pressurizing wedges 29 to 35 are preferably manufactured from round stock material so that they are easy to manufacture. However, they can also have, for example, a square cross-section. With the supporting sheet 47 the pressurizing wedges are maintained in their represented positioned in which they are abutting one another with their lateral surfaces, respectively, their wedge-shaped end faces 42 to 46 and 52 to 59 and, in the non-clamped position, rest with their smaller or greater base sides of their trapezoidal cross-section at the bottom 22 of the longitudinal slot 19. In the axial direction the pressurizing wedges are positioned between the abutment 27 and the adjusting member 28. The clamping member 11 with the pressurizing member 10, the abutment 27, the adjusting member 28, and the support 47 may be combined to a premounted unit which as a unit can be inserted into the corresponding receiving groove 2 for securing and clamping the blade 3. Instead of the pressure or clamping screw used as an adjusting member 28, it is also possible to use a spring or a hydraulic or pneumatic piston, with which a hydraulic or pneumatic medium is activated, for clamping the pressurizing wedges 29 to 35.

For clamping the blade 3 the pressure or clamping screw 28 is turned in the direction of arrow P in FIG. 3 into the bore 26 of the clamping member 11. The screw 28 at its free end has a pressure part 61 with which it rests at the end face 44 of the pressurizing wedge 35. The axis of the screw 28 and of the pressure part 61 are perpendicular to the end face 44.

When threading the screw 28 into the bore, its pressure part 61 presses against the neighboring pressurizing wedge 35 which with its end face 46 exerts a pushing force onto the neighboring wedge-shaped end face 43 of the pressurizing wedge 38. The pushing force has a horizontal and a vertical force component. Each pressurizing wedge thus exerts a corresponding pushing force onto the neighboring pressurizing wedge whereby the pressurizing member 10 is forced against the abutment 27 and the centrally arranged pressurizing wedges 30, 32, 34 are forced in the direction of arrow P' in FIG. 2 against the clamping member 11. The pressurizing wedges 29, 31, 33, 35, on the other hand, are subjected to a force in the direction toward the bottom section 6. The support 47 is elastically deformed so that it comes into contact with the bottom section 6 and the pressurizing wedges are able to support themselves via the support 47 at the bottom section 6. The clamping member 11 is forced by the force acting on it against the blade 3 so that it is fixedly clamped within the receiving groove 2 between the slanted surface 13 of the clamping member and the neighboring sidewall 5 of the receiving groove and is thus securely fastened in this position within the groove. This clamping method is especially useful for very long blades 3 for clamping them securely over the entire length. Since the pressurizing member 10 is comprised of individual pressurizing elements provided with edge-shaped end faces which, compared to the length of the clamping member 11, are short it is not necessary to manufacture the pressurizing elements 29 to 35 exactly to the dimensions of the clamping member 11. Every other pressurizing element is firmly pressed against the bottom 22 of the slot 19 of the clamping member 11 due to the aforedescribed embodiment.

In order for the pressurizing wedges 29 to 35 to be axially and circumferentially exactly aligned with one another they are provided with securing elements that prevent their rotation relative to one another. Thus, it is ensured that the pressurizing wedges 29 to 35 with their respective wedge-shaped end faces 42, 45; 52, 58; 54, 55; 56, 57; 58, 59; 43, 46 rest areally at one another. The clamping force generated with the screw 28, as described above, is thus maintained during machining processes performed with the blade head.

The securing elements are in the form of planar lateral surfaces 75 and 76 (FIG. 18) at the pressurizing elements 29 to 35 with which they rest at the corresponding counter clamping surfaces during clamping. In FIG. 11 this is represented for the pressurizing wedges 33 and 32. They are, as explained above, forced against the (non-represented) support 47, respectively, against the bottom 22, as can be seen in FIG. 11.

As can be further taken from FIG. 11, the support 47 must not be provided. It may be advantageous to clamp the corresponding pressurizing wedges directly against the bottom section 6 of FIG. 1 of the receiving groove 2. In the clamping position the pressurizing wedges rest with their lateral surfaces 75, 76 areally at the corresponding counter clamping surfaces. It is thus ensured that the pressurizing wedges 29 to 35 are exactly aligned so that the force generated by the screw 28 is transmitted via the wedge-shaped end faces onto the pressurizing wedges 29 to 35 in a reliable manner.

The distance of the lateral surfaces 75, 76 of each pressurizing wedge 29 to 35 is slightly smaller than the distance between the projections 77, 78 which are extending toward one another (FIG. 11) and project past the sidewalls 20, 21 of the longitudinal slot 19. Thus are arranged at the level of the underside 12 of the clamping member 11. The pressurizing wedges 29 to 35 are inserted into the longitudinal slot 19 such that their lateral surfaces 75, 76 are oriented parallel to the ends of the projection 77, 78. Subsequently, they are rotated about their longitudinal axis about 90° within the longitudinal slot 19 to be positioned as required for their correct mounting. In this position, the pressurizing wedges 29 to 35 can no longer fall out of the longitudinal slot 19 due to the projections 77, 78. Due to these projections 77, 78 a support 47 is no longer needed. The corresponding pressurizing wedges in the clamping position project past the projections 77, 78 from the longitudinal slot 19 and are supported with their corresponding lateral surfaces 75, 76 at the bottom section 6 of the receiving groove 2, as is clearly shown in FIG. 11 with the exemplary pressurizing wedge 33.

The longitudinal slot 19 within the clamping member 11 is deep enough so that the pressurizing wedges 29 to 35 can be clamped with a required force at the bottom 22 and at the bottom section 6.

Figure 12:
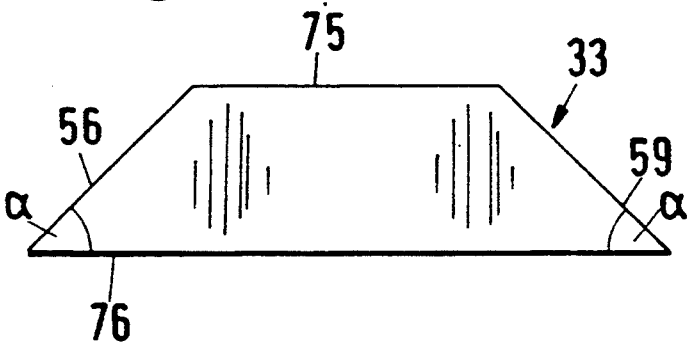
FIG. 12 is a side view of a pressurizing element; and is an end view of a pressurizing element according to FIG. 12.
Figure 13:
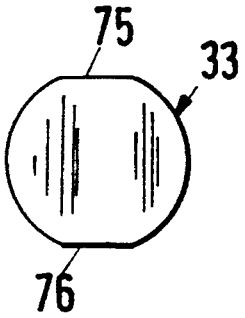

The wedge angle $\alpha$ (FIG. 12) of the pressurizing wedges 29 to 35 is preferably 45° and in any case is smaller than the angle with which self-hindrance would occur. During the clamping process the pressurizing wedges can therefore be easily displaced relative to one another. Since the pressurizing wedges are contacting one another in an areal manner and rest with their lateral surfaces 75, 76 areally at the counter clamping surfaces, an optimal force transmission with minimal wear is ensured.

Figure 4:
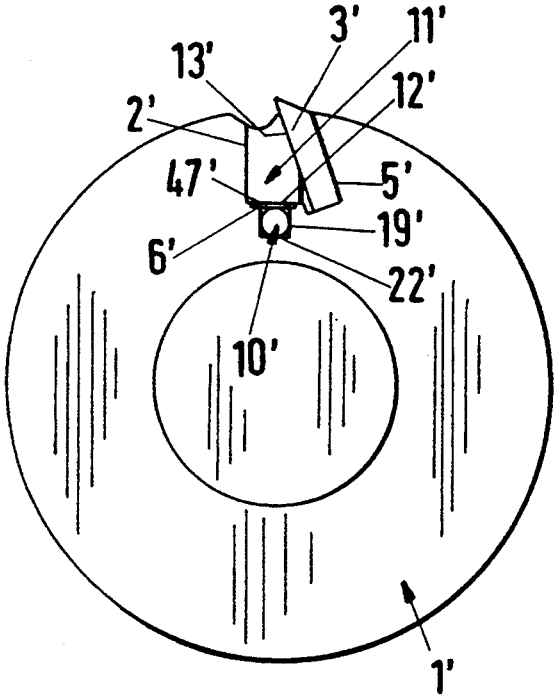
FIGS. 4 to 6 show a further embodiment of the inventive blade head in representations corresponding to FIG. 1.

The embodiment according to FIG. 4 differs from the aforedescribed embodiment essentially by providing the pressurizing member 10' in a longitudinal slot 19' of the blade holder 1' at the bottom of the receiving groove 2'. The longitudinal slot 19' is substantially identically embodied as the longitudinal slot 19 according to the embodiment of FIG. 1 to 3 and provided as a depression within the bottom section 6' of the receiving groove. The longitudinal slot 19' is symmetrically arranged relative to the receiving groove 2' and is outwardly closed by a support 47' that is connected with its longitudinal edges to the bottom section 6' and secures the pressurizing wedges arranged within the longitudinal slot 19'. When the clamping member 11' is provided with projections 77, 78 according to FIG. 11, the support 47' is not necessary. The clamping member 11', with the exception that the longitudinal groove 19 is missing, is embodied identically to the clamping member 11 of FIGS. 1 to 3. The pressurizing member 10' is embodied identically to the pressurizing member 10 of the aforedescribed embodiment. The longitudinal slot 19' on both ends is closed off by the end faces of the blade head 1' in which the abutment and the adjusting member are supported in the same manner as in the embodiment described supra. They are arranged in a recessed manner so that they do not project outwardly in the axial direction. When threading the adjusting member, not represented in the drawing, into the bore, the centrally arranged pressurizing wedges of the pressurizing member 10' exert in the aforedescribed manner radially outwardly oriented pressure forces on the clamping member 11' while the interposed pressurizing wedges are forced radially inwardly against the bottom 22' of the longitudinal slot 19'. The support 47' is elastically deformed and rests at the planar underside 12' of the clamping member 11'. Accordingly, the clamping member 11' is loaded in the aforedescribed manner by the pressurizing wedges in the direction of arrow P' so that the blade 3' is clamped between the slanted surface 13' and the side wall 5' of the receiving groove 2'.

Figure 5:
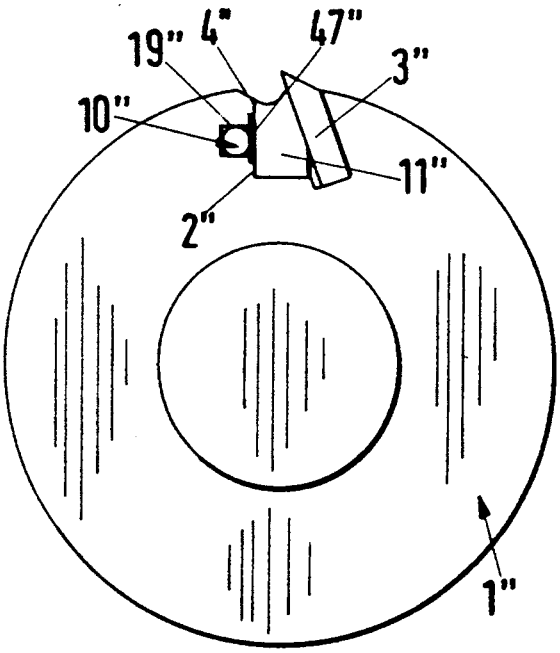

The embodiment according to FIG. 5 differs from the embodiment according to FIG. 4 only by having the longitudinal slot 19'' for receiving the pressurizing member 10'' arranged in the sidewall 4'' of the receiving groove 2''. The pressurizing wedges of the pressurizing member 10'' contact via the support 47'' the clamping member 11'' on a side thereof oppositely arranged to the blade 3''. The pressurizing member 10'', the clamping member 11'', and the receiving groove 2'' are otherwise identically embodied as in the aforedescribed embodiments. During clamping the clamping member 11'' is forced by the pressurizing wedges of the pressurizing member 10'' in the aforedescribed manner against the blade 3'' which is thus securely clamped within the receiving groove 2''. When the longitudinal slot 19'' is provided with projections 77, 78 according to FIG. 11 the support 47'' is not required.

Figure 6:
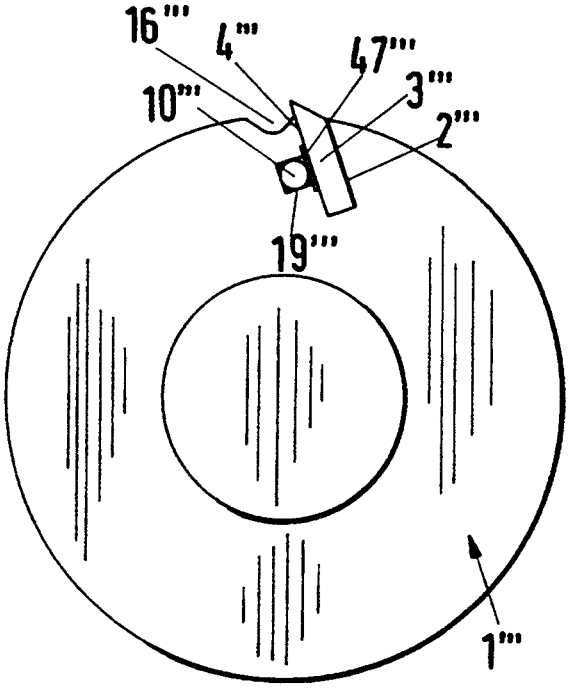

In FIG. 6 a further embodiment is represented in which for clamping of the blade 3''' within the receiving groove 2''' of the blade holder 1''' only the pressurizing member 10''' is provided which is arranged in the longitudinal slot 19''' of the blade holder. In this embodiment a clamping member is not necessary. The longitudinal slot 19''' is a depression in the side wall 4''' of the receiving groove 2''' and extends parallel to the axis. The non-represented pressurizing wedges of the pressurizing member 10''' are secured within the longitudinal slot 19''' by the support 47''' which is attached, as disclosed in the embodiment according to FIG. 5, with its longitudinal edges within flat depressions directly adjacent to the slot 19''' within the side wall 4''' of the receiving groove 2'''. The blade 3''' to be clamped can thus rest directly at the flat depressions within the side wall 4'''. The longitudinal slot 19''', as described supra, is closed by the end faces of the blade holder 1''' The pressurizing wedges rest at the non-represented abutment and the non-represented adjusting member which are arranged within the end faces of the blade holder 1''' in a recessed manner. In this embodiment the pressurizing wedges of the pressurizing member 10''' act directly via the support 47''' on the blade 3'''. The clamping groove 16''' is arranged in front of the blade 3''' within the blade holder 1''' and extends forwardly in the direction of rotation in the circumferential direction from the sidewall 4''', of the blade holder 1'''.

The supports 47, 47', 47'', 47''' have the same function as the projection 77, 78, i.e., to secure the pressurizing wedges against falling out of the corresponding longitudinal slots 19, 19', 19'', 19'''. When projections 77, 78 are provided they take over the securing function so that the supports 47 to 47''' are no longer required. The securing elements or supports further prevent that dirt can be introduced into the longitudinal slots and soil the pressurizing wedges thereby inhibiting the easy displacability of the wedges.

In the embodiment according to FIGS. 1 to 6 the pressurizing members of each individual blade are actuated individually, as has been described for the embodiments according to FIGS. 1 to 3.

However, it is also possible that all pressurizing members are actuated by one clamping device simultaneously. Two of such embodiments are shown in FIGS. 7, 8 and 9, 10.

Figure 8:
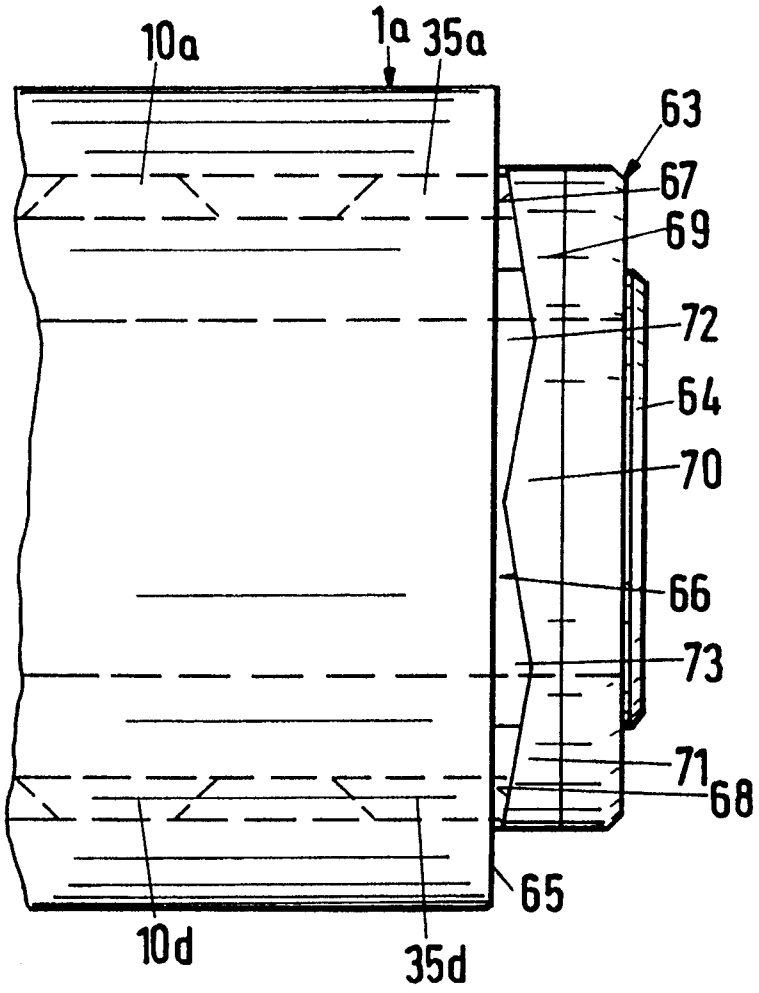
FIG. 8 shows a detail of the inventive blade head according to FIG. 7 in a side view whereby only two pressurizing wedges are represented.
Figure 7:
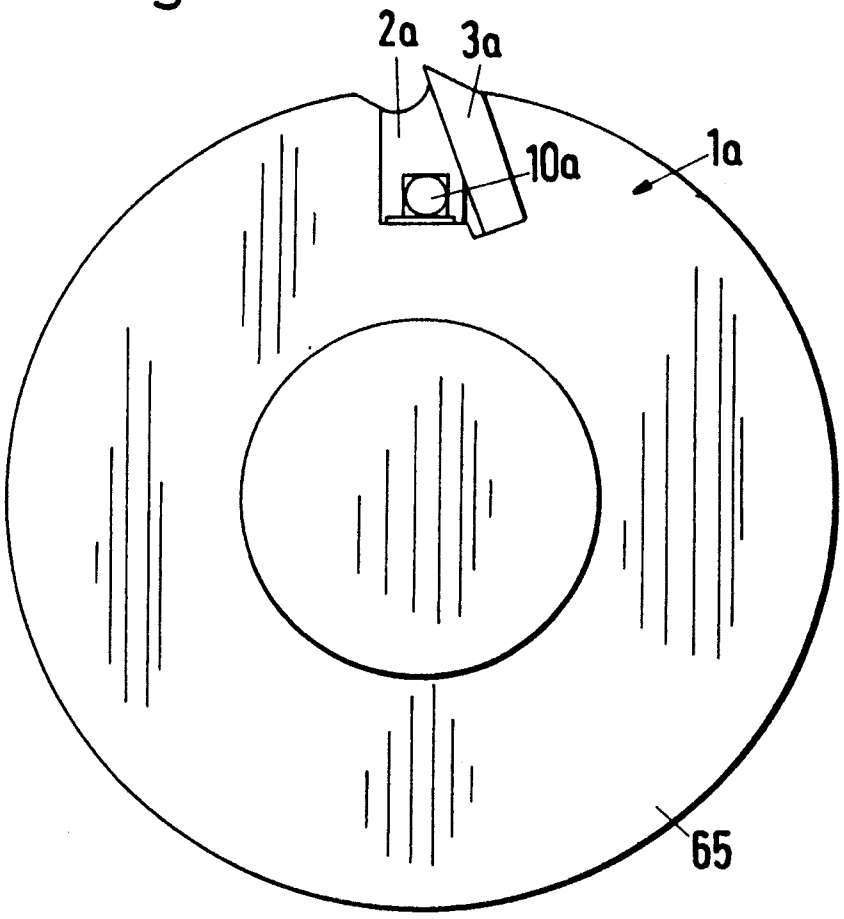
FIG. 7 is an end view of a further embodiment of an inventive blade head with an adjusting element for clamping a plurality of clamping members.

In the embodiment according to FIGS. 7 and 8 one single adjusting member 63 is provided instead of the individual pressure and clamping screws 28 coordinated with each individual pressurizing member. The adjusting member 63 is in the form of an adjusting ring which is positioned on the spindle 64 of the blade holder and which can be attached and secured to it. At the underside 66 facing the end face 65 of the blade holder 1*a* the adjusting ring is provided with a zigzag profiling shown in a side view in FIG. 8. Upon rotation of the adjusting ring 63 the zigzag profiling cooperates with the pressurizing parts 10*a* and 10*d*. The pressurizing members are essentially identically embodied to the pressurizing member 10 of FIGS. 1 to 3. They differ only in that the pressurizing elements 35*a* and 35*d* arranged at the ends extend past the end face 65 of the blade holder 1. The projecting ends with the end faces 67 and 68 cooperate with the underside 66, respectively, the profiling of the adjusting ring 63 at which they are areally supported. In the represented clamping position of the pressurizing parts 10*a* and 10*d* the end faces 67 and 68 of the pressurizing members are positioned within the area of the projection 69 to 71 of the underside 66, while before clamping the blades 3 within the receiving groove 2 of the blade holder 1 they are positioned within the area of the depressions 72 to 73 of the adjusting ring 63. The profiling 66 is embodied such that upon rotation of the adjusting ring 63 the pressurizing wedges of all pressurizing members 10*a* and 10*d* are simultaneously pressed against one another so that in the aforedescribed manner the blade 3*a* is clamped within the receiving groove 2*a*. At the end opposite the adjusting ring 63 an abutment is provided that is identical to the one disclosed in FIG. 2.

Figure 10:
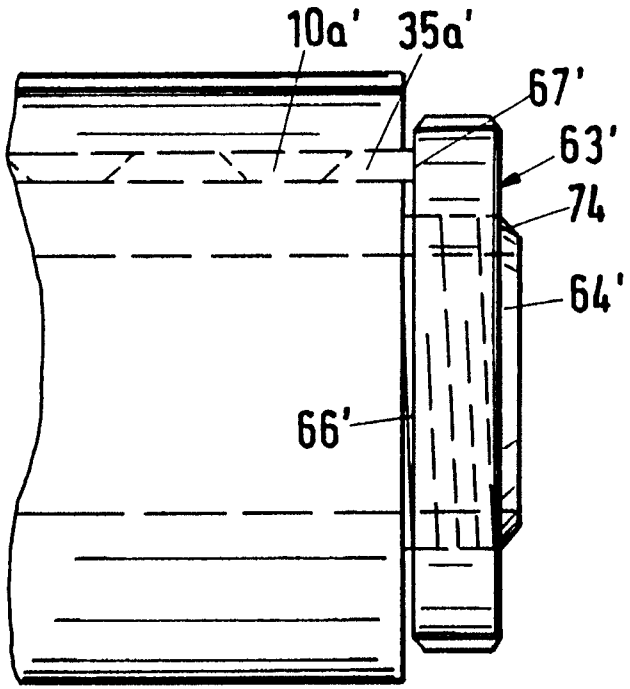
FIG. 10 is a blade head according to FIG. 9 in a representation corresponding to FIG. 8 whereby only one pressurizing element is represented.
Figure 9:
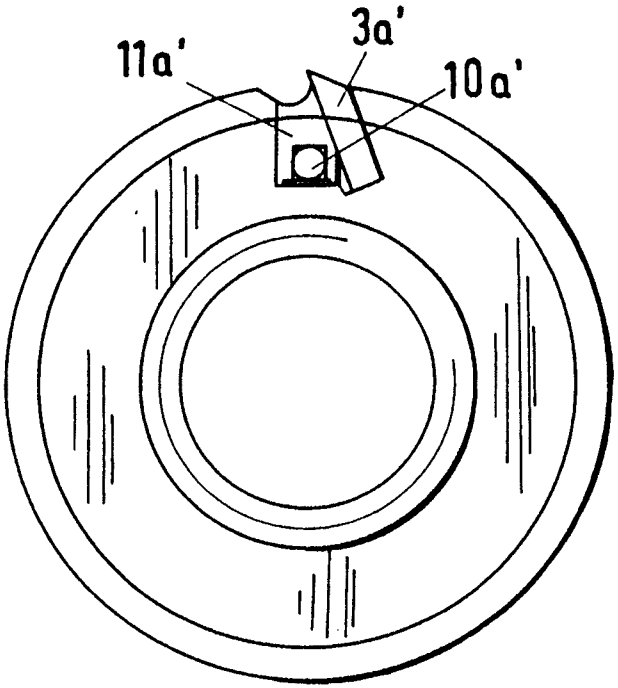
FIG. 9 is a representation corresponding to FIG. 7 for a further embodiment of the inventive blade head.

In the embodiment according to FIGS. 9 and 10 the adjusting member 63' is again in the form of an adjusting ring with which all pressurizing members 10*a*' can be simultaneously adjusted for clamping the knives 3*a*'. The adjusting ring 63' differs from the adjusting ring 63 according to FIGS. 7 and 8 by having the underside 66' as a planar annular surface. The pressurizing elements 35a' rest with their end faces 67' at this annular surface. The adjusting ring 63' is provided with an inner thread with which it is threaded onto the outer threaded portion 74 of the spindle 64'. With the adjusting ring 63' all blades 3a' of the blade head can be clamped simultaneously via the pressurizing members 10a' and the clamping members 11a', as described for the embodiment of FIGS. 7 and 8. For this purpose, the adjusting ring 63' is threaded onto the spindle 64' in the direction toward the blade head 1a' so that the pressurizing wedges of all pressurizing members 10a' are simultaneously pressed against one another, thereby clamping the blades 3a'.

Of course, it is also possible to use instead of the mechanical adjusting members 63 and other adjusting devices for simultaneously clamping the blades. For example, the pressurizing elements can also be simultaneously activated by hydraulic, pneumatic or other adjusting members. In each case, however, it is also possible to individually clamp the blades with the clamping and pressurizing members, as described in the embodiment according to FIG. 6, with the pressurizing members within the blade head.

In the embodiments according to FIGS. 7 to 10 the clamping devices can also be embodied as disclosed for the embodiments of FIGS. 4 to 6.

The present invention is, of course, in no way restricted to the specific disclosure of the specification and drawings, but also encompasses any modifications within the scope of the appended claims.

What I claim is:

1. A blade head for cutting and planing blades, comprising:

a blade holder having a plurality of receiving means for receiving a cutting and planing blade, said receiving means distributed over a circumference of said blade holder;

a plurality of pressurizing elements positioned in each said receiving means for holding the cutting and planing blade in said receiving means;

at least one adjusting member positioned in each said receiving means for forcing said pressurizing elements against one another such that said pressurizing elements exert a clamping pressure on the cutting and planing blade;

said pressurizing elements having a substantially cylindrical shape with wedge-shaped end faces and with a circumferential surface having at least one planar clamping surface, with adjacent ones of said pressurizing elements abutting one another with said end faces; and said blade holder having clamping counter surfaces cooperating with said planar clamping surfaces of said pressurizing elements.

2. A blade head according to claim 1, wherein said planar clamping surfaces are positioned at an acute angle to said wedge-shaped end faces.

3. A blade head according to claim 1, wherein each said pressurizing element has two of said planar clamping surfaces that are parallel to one another.

4. A blade head according to claim wherein a first one of said planar clamping surfaces in an axial direction of said pressurizing element is shorter than a second one of said planar clamping surfaces.

5. A blade head according to claim 3, wherein said receiving means comprises a longitudinal slot into which longitudinal slot said pressurizing elements are placed.

6. A blade head according to claim 5, further comprising a clamping member positioned in each said receiving means, said clamping member having said longitudinal slot and resting at the cutting and planing blade.

7. A blade head according to claim 6, wherein said longitudinal slot has a bottom, longitudinal sidewalls and an opening opposite said bottom, said opening being narrower than said bottom.

8. A blade head according to claim 7, wherein each said sidewall at said opening has a longitudinal projection extending toward one another.

9. A blade head according to claim 8, wherein a distance between said projections is greater than a distance between said two planar clamping surfaces.

10. A blade head according to claim 8, wherein a diameter of said cylindrical shape of said pressurizing elements is Greater than said distance between said projections.

11. A blade head according to claim 5, wherein said longitudinal slot is provided within said blade holder.

* * * * *